US005390402A

United States Patent [19]

White et al.

[11] Patent Number: 5,390,402

[45] Date of Patent: Feb. 21, 1995

[54] APPARATUS FOR INSTALLING GUIDE TUBES FOR INSTRUMENTATION SIGNAL BEARING WIRES IN THE BEARING HOUSING OF A TURBINE

[75] Inventors: Loren H. White, Scotia, N.Y.; Micah F. Johnson, Greenville, S.C.

[73] Assignee: General Electric Company, Schenectady, N.Y.

[21] Appl. No.: 9,100

[22] Filed: Jan. 26, 1993

[51] Int. Cl.[6] ..... B23P 19/04

[52] U.S. Cl. ..... 29/241

[58] Field of Search ..... 29/889, 433, 241, 237, 29/240; 254/134.3 R, 134.3 FT; 285/333, 334

[56] References Cited

U.S. PATENT DOCUMENTS

| | | | |
|---|---|---|---|
| 1,858,997 | 5/1932 | Lewin | 254/134.3 FT |
| 1,993,269 | 3/1935 | Fletcher | 285/333 |
| 2,216,945 | 10/1940 | Hinderliter | 285/333 |
| 3,066,916 | 12/1962 | Shaw | 254/134.3 R |
| 3,126,214 | 3/1964 | Wong et al. | 285/333 |
| 4,456,225 | 6/1984 | Lucas | 254/134.3 FT |
| 4,688,762 | 8/1987 | DeBeradinis | 254/134.3 FT |

*Primary Examiner*—Robert C. Watson
*Attorney, Agent, or Firm*—Nixon & Vanderhye

[57] ABSTRACT

Segmented guide tubes for the signal-bearing wires for journal and thrust bearing instrumentation are received in the lower bearing housing section without removal of the rotor or major tear-down of the turbine. Guide tube segments for the thrust bearings are specifically shaped and configured to enable remote or blind threaded connection within the lower housing section with fittings facilitating the "feel" for the alignment necessary to thread a first straight tube segment from above the lower housing section into the fitting of a second guide segment introduced into the drain hole of the lower housing section. Once threaded together, signal-bearing wires may be snaked through the resultant guide tube assembly. Guide tubes for the journal bearing include side guide tube segments secured at their upper ends to the lower housing section and to a Y-tube connection at their lower ends. A pair of guide tubes are assembled with one guide tube end being coupled to the Y-tube fitting and carrying a self-locking leaf spring support for securing the aft end of one guide tube end in a reduced cavity in the lower housing section by remote means. The latter pair of guide tube segments are clamped to a drain pipe in the drain opening with the second segment passing through a penetration opening in the bearing housing.

6 Claims, 4 Drawing Sheets

APPARATUS FOR INSTALLING GUIDE TUBES FOR INSTRUMENTATION SIGNAL BEARING WIRES IN THE BEARING HOUSING OF A TURBINE

TECHNICAL FIELD

The present invention relates generally to turbine bearing housing instrumentation and particularly relates to apparatus and methods of field or factory retrofitting special guide tubes used for conducting signal-bearing wires or cables from instrumentation within a rotor bearing housing to readout devices external to the bearing housing. Specifically, the present invention is directed to the introduction, assembly, tightening and mounting of segmented guide tubes, some steps being implemented by remote means, without major tear-down of the turbine or removal of its rotor.

BACKGROUND

As well known, turbine bearing housing instrumentation typically includes thermocouples and proximity probes in the region of the thrust and journal bearings for the turbine rotor. During normal operation, both types of instrumentation are used to measure important physical conditions within each bearing housing. Measurement is accomplished with external meters which receive electrical signals from the instrumentation through insulated wires or cables (hereafter referred to as wires or signal-bearing wires). By necessity, the wires pass through each housing at convenient penetration points which are sealed to prevent oil leakage. Externally, the wires are enclosed within a conduit to provide protection from hostile environmental conditions. Internally, the wires are enclosed within guide tubes securely mounted to and within each bearing housing. It is important to enclose the wires within the housing; because undue wire flexing, unless restricted, results in damage to the wires due to whipping or flailing of the wires caused by turbulent oil flow within the housing.

Bearing housings of a turbine rotor typically includes upper and lower housing sections split along a generally horizontal plane such that the upper housing section may be removed for inspection and maintenance of signal-bearing wires and protective guide tubes, associated with the bearings and other parts. Bearing instrumentation are generally located in the lower housing section. When it is desired to retrofit instrumentation components, guide tubes and wires into a bearing housing, general installation of the same has heretofore been possible in the field, or on other occasions in the factory, only after rotor removal and major tear-down of the turbine. It will also be appreciated that, with the upper bearing housing section removed, access to the lower bearing housing section is extremely limited due to the presence of the bearings and the rotor in the lower housing section. Moreover, it is costly and time-consuming to remove the rotor and other parts of the turbine to facilitate access into the lower housing for purposes of installing bearing instrumentation and related material. It will also be appreciated that the lower housing section is closed and generally inaccessible along its sides except for lubrication drain and supply penetration points which open through the end face or bottom of the bearing housing. Thus, limited access to the inside of the lower housing section has prevented ready retrofitting of protective guide tubes for instrumentation signal-bearing wires without major tear-down of the entire turbine and removal of its rotor. Normally, guide tubes are installed upon the initial manufacture of the turbine and general retrofitting heretofore has been considered clearly impractical due to the foregoing shortcomings.

DISCLOSURE OF THE INVENTION

In accordance with the present invention, two (or more) sets of guide tubes with two or more segments are provided of a specific design and configuration to facilitate their introduction, assembly and mounting under the adverse conditions of limited access and confined space of an open, but fully assembled lower bearing housing section with its attendant turbine rotor in place. The first set of guide tubes, discussed herein relative to guidance and protection of signal-bearing wires of thrust bearing instrumentation, consists of a first, straight or linear segment and a second segment having an elbow at one end and a bend at its opposite end. When installed, the first segment extends generally vertically within the lower housing section and the second guide tube extends generally horizontally within the drain opening. The lower and upper ends of the first and second segments are screw-threaded one to the other to form an assembly of the first set. To achieve the screw-threading action within the confined and limited space within the lower bearing housing section with the rotor in place and substantially without visual contact with the screw-threaded joint, the ends of the first and second segments to be joined have special features which enable a pair of installers to mechanically sense or feel when the tube ends are engaged and aligned one with the other, whereby remote thread-joining action can be implemented.

To accomplish this, special male and female fittings are provided on the ends of the respective first and second segments. Both fittings have protruding cylindrical ends for initial, loose-fitting engagement of the cylindrically open ends of the fittings. Both fittings also have conical surfaces spaced from their ends to facilitate positive initial contact with one another prior to engagement of the fitting's threads. As a result, these special features enable installers, by remote means, to sense and recognize when the segment's fittings are (1) engaged, (2) aligned and (3) fully tightened, all without the benefit of full visual access.

Thus, to install the segmented set of guide tubes for the thrust bearings, the upper bearing housing section is removed. Also, the installer typically removes the pipe flange from the end face of the turbine, exposing the end drain opening. The bent segment is manually inserted into the drain opening and its near end is inserted through a special penetration hole drilled in the bearing housing. A collar is welded to that portion of the segment exposed externally through the penetration hole to form a restraint relative to a shoulder machined in the penetration hole of the bearing housing. Another installer inserts the straight segment through the open upper face and along a side of the lower housing section. The lower end of the straight segment and the far end of the bent segment are then manipulated to insert the male fitting into the female fitting and to engage the cylindrical protrusions. By further manipulation, the installer(s) can mechanically sense or "feel" when alignment is obtained, meaning complete annular surface-to-surface contact of the respective conical surfaces. After the segments are engaged and aligned, the straight segment may be rotated, as its own wrench, to start the threaded engagement between the two segments. Once the segment's threads are finally engaged and tightened, the upper end of the straight first segment is secured to the side frame of the lower housing section by a bracket, while the lower end of the bent section segment is secured at the bearing housing's penetration point by means of the above-mentioned attached collar.

It will be appreciated that the initial engagement and connection, as well as the threading action of the two segments, are performed substantially blind. That is, neither the installer holding the bent segment in the drain cavity nor the installer guiding and rotating the straight segment within the open diametrical face of the lower bearing housing section have full visual access to the ends of the segments to be engaged, aligned and connected. Hence, the cylindrical protrusions and the conical surfaces of the special fittings and the attendant single straight segment enable virtually blind engagement, connection and tightening of the segment's fittings, all by remote means.

The second set of guide tubes, relative to journal bearing instrumentation, similarly comprise two or more guide tube segments employed in conjunction with a rotatable, self-aligning Y-tube fitting and left and right tube segments. The first and second guide tube segments, provided with a snap ring on the aft end of the first segment for retention and free-rotation with respect to the Y-tube fitting, are inserted, connected and housed in the drain opening. Thereafter, left and right tube segments are secured on opposite sides of the lower housing section and extend to the bottom of the aft journal bearing. Each segment is secured respectively at its lower end to left and right legs of the Y-tube fitting and at its upper end by an accessible clamp located on each side of the lower housing section, open at the top. By using a pair of hook wires through the Y-tube fitting and hook wires through each of the left and right segments as a means of achieving remote alignment, slip fit connections are made between left and right legs of the Y-tube fitting and the lower ends of left and right tube segments.

Upon final installation, the first and second guide tube segments are rigidly secured within the bearing housing section. This is accomplished with a U-bolt provided about a drain pipe extending in the drain opening. The first segment for the most part is generally linear, has a short bent portion for securement to a clamp, the bent portion also carrying an end-sleeve. The second segment, featuring two (or more) bends, has one end for reception with a penetration hole provided in the side of the lower housing section. The opposite end of the second segment is receivable in the end-sleeve of the first segment. Each segment is secured to the U-bolt with two clamps, one on each side of the end-sleeve.

The aft or far end of the first guide tube segment is also attached to one leg of a self-locking generally V-shaped leaf spring to provide aft support. The apex of the leaf spring carries a bolt and nut combination for spring-load adjustment at assembly. To install the first guide tube segment used for bearing wires for the journal bearing instrumentation, a cord with a slipknot is disposed about the spring to maintain the spring in a compressed condition. With the spring compressed, the first segment is inserted into the drain opening and the near end of the second segment is passed into the penetration opening of the housing section. The aft end of the first segment bearing the V-shaped spring is disposed in a reduced drain opening cavity, the compressed nature of the spring permitting the spring to be readily introduced into the confined space of the reduced cavity with clearance between its legs and apex and the side walls of the cavity. Additionally, the far end of the first segment is provided with the rotatable, self-aligning Y-tube fitting, previously attached for later engagement with left and right guide tube segments. When the first segment, its spring and its rotatable, self-aligning Y-tube fitting are properly positioned and the end-sleeve of the first segment is engaged with the end of the second, both segments are clamped to the drain pipe. Thereafter, the slipknot is released remotely and the cord is removed from the drain opening. The leaf spring then flexes to engage the tips of its legs and its apex against the walls of the reduced cavity wherein the angular bias of the spring geometry provides self-locking means to wedge the spring within the housing, thus forming a secure three-point, remotely-installed mount at the first end of the first segment. A nut and bolt combination of the leaf spring at its apex also permit spring load adjustment at assembly, prior to removal of the spring's compression cord.

In a preferred embodiment, according to the present invention, having a turbine with a rotor, a housing for the bearings of the rotor split to define upper and lower housing sections, and a lubrication drain hole opening through the lower housing section, there is provided apparatus for guiding signal-bearing wires from instrumentation located within the bearing housing to at least one signal readout device external of the housing and receivable within the lower housing section upon removal of the upper housing section but without removal of the rotor, comprising a first generally linearly extending guide tube having a lower threaded end and receivable within the lower housing section and a second guide tube having an upper threaded end and receivable within the drain hole for threaded engagement with the lower end of the first guide tube. Also provided are means carried by at least one of the guide tubes at its lower end and the second guide tube at its upper threaded end for ensuring alignment of the guide tube ends to facilitate substantially blind threaded engagement of the ends.

In a further preferred embodiment, according to the present invention, having a turbine with a rotor, a housing for the bearings of the rotor split to define upper and lower housing sections, and a lubrication drain hole opening through the lower housing section, there is provided apparatus for installing guide tubes and signal-bearing wires from instrumentation located within the bearing housing to at least one signal readout device external of the housing and receivable within the lower housing section upon removal of the upper housing section but without removal of the rotor, comprising a first generally linearly extending guide tube and a second guide tube, with a connecting sleeve for slip-joining ends of the guide tubes one to the other, and a third or side guide tube within the lower housing part and connected to an opposite end of the first guide tube. Mounting means for the first and second guide tubes include a clamp for rigid securement within the lower housing part and within the drain hole for securing ends of the first and second tubes adjacent the sleeve with the sleeve located between the clamped ends of the first and second tubes, and means coupled to the first tube adjacent the opposite end for securing the first tube to the housing within the drain hole.

In a further preferred embodiment, according to the present invention, having a turbine with a rotor, a housing for the bearings of the rotor split to define upper and lower housing sections, instrumentation in the bearing housing and a lubrication drain hole opening through the lower housing section, there is provided a method of installing guide tubes for carrying signal-bearing wires from the instrumentation within the housing to at least one signal readout external of the housing, comprising the steps of inserting a first generally linearly extending guide tube having a lower threaded end into the lower housing section through an opening formed by removal of the upper housing section, inserting a second guide tube having a bend and threads at an upper end thereof into the drain hole, guiding at least one of the tubes to establish alignment between the lower ends of the first tube and the upper end of the second tube and threading the tube ends one with respect to the other by rotating one of the tubes after alignment of the ends has been established to secure the threaded ends to one another.

In a further preferred embodiment, according to the present invention, having a turbine with a rotor, a housing for the bearings of the rotor split to define upper and lower housing sections, instrumentation in the bearing housing and a lubrication drain hole opening through the lower housing section, a method of installing guide tubes for carrying signal-bearing wires from the instrumentation within the housing to at least one signal readout external of the housing, comprising the steps of inserting a first guide tube into the lubrication drain hole opening, providing a securement means adjacent one end of the first guide tube prior to insertion thereof into the drain hole opening such that the securement means, upon insertion into the drain hole, extends adjacent a far end of the drain opening and actuating the securement means to engage wall surfaces defining the drain hole when the securement means is located adjacent the far end of the drain hole opening to secure the end of the guide tube within the drain opening.

In a still further preferred embodiment, according to the present invention, in a turbine with a rotor, a housing for the bearings of the rotor split to define upper and lower housing sections, thrust and journal bearings in the bearing housing, instrumentation for each of the thrust and journal bearings in the bearing housing and a lubrication drain hole opening through the lower housing section, a method of installing guide tubes for carrying signal-bearing wires from the thrust and journal bearing instrumentation within the housing to at least one signal readout external of the housing, comprising the steps of inserting a first guide tube having a threaded end into the lower housing section through an opening formed by removal of the upper housing section, inserting a second guide tube having a threaded end into the drain hole, threading the tube ends one with respect to the other while in the lower housing section by rotating one of the tubes to secure the threaded ends to one another, passing signal-bearing wires through the first and second guide tubes for connection with the thrust bearing instrumentation, inserting a first guide tube, for carrying the signal-bearing wires for the journal bearing instrumentation, into the lubrication drain hole opening, providing a securement means adjacent one end of the first guide tube for the journal bearing instrumentation wires prior to insertion thereof into the drain hole opening such that the securement means, upon insertion into the drain hole, extends adjacent a far end of the drain opening and actuating the securement means to engage wall surfaces defining the drain hole when the securement means is located adjacent the far end of the drain hole opening to secure the end of the latter-mentioned guide tube within the drain opening.

Accordingly, it is a primary object of the present invention to provide novel and improved apparatus and methods for installing guide tubes for instrumentation signal-bearing wires in the bearing housing of a turbine without the necessity to remove the rotor or major tear down of the turbine.

BEST MODE FOR CARRYING OUT THE INVENTION

Reference will now be made in detail to a present preferred embodiment of the invention, an example of which is illustrated in the accompanying drawings.

Figure 1:
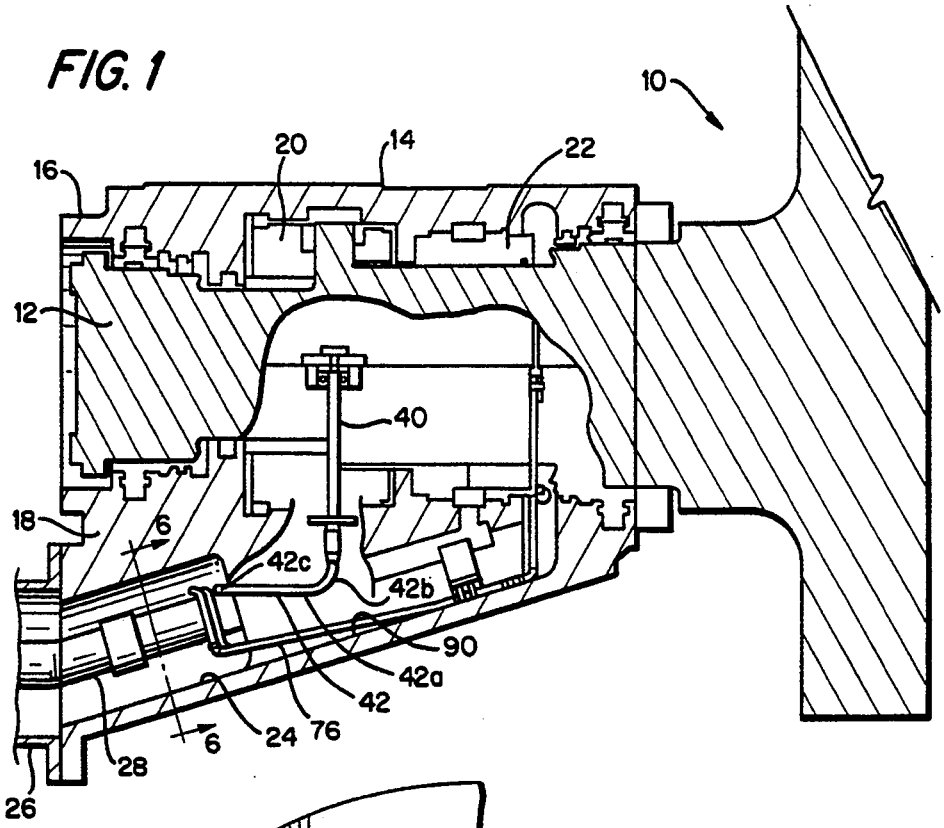
FIG. 1 is a partial cross-sectional side view through an end of a turbine illustrating the turbine rotor, journal and thrust bearings, the turbine bearing housing and guide tubes for the signal-bearing wires of instrumentation disposed in the bearing housing.
Figure 2:
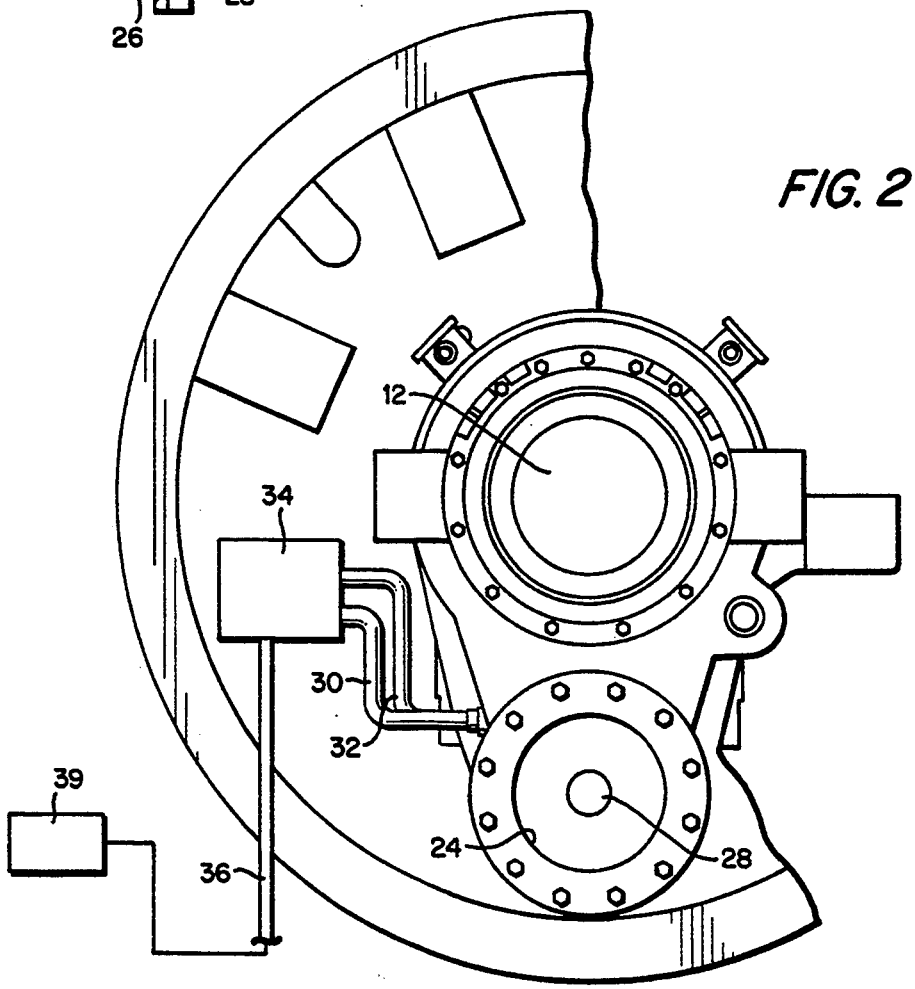
FIG. 2 is a partial end elevational view looking aft, from left to right in FIG. 1.
Figure 3:
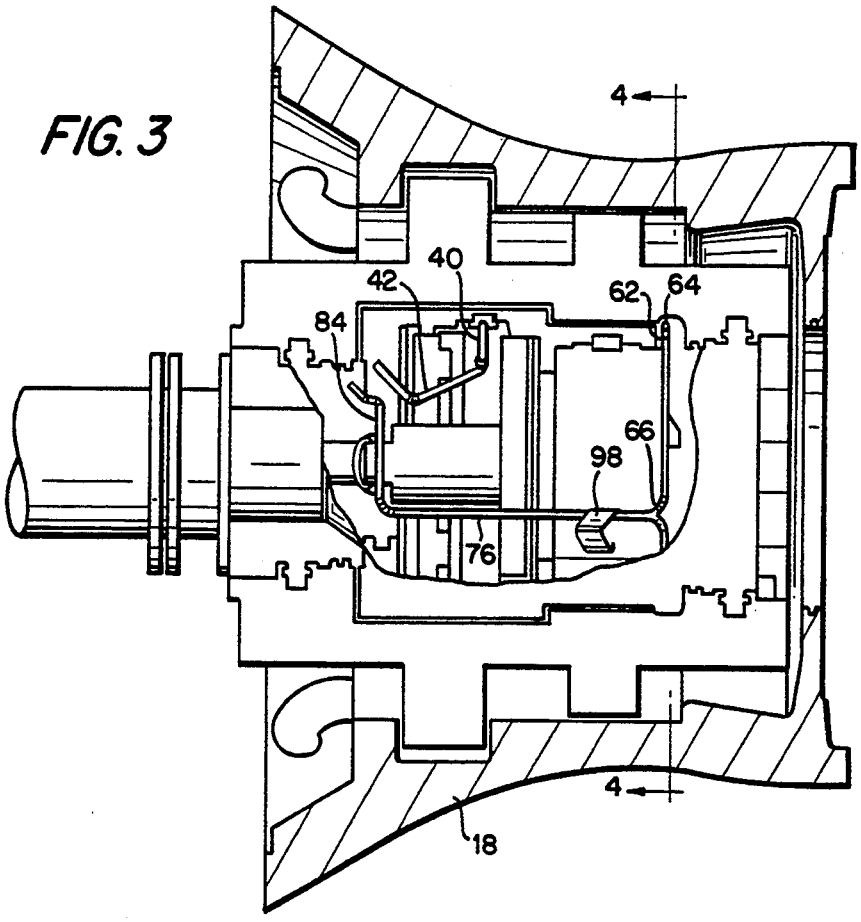
FIG. 3 is a partial cross-sectional plan view of the lower bearing housing section illustrated in FIG. 1 with the upper housing section removed.

Referring now to FIG. 1, there is illustrated a portion of a turbine, generally designated 10, including an end of the turbine rotor 12 disposed in a bearing housing 14, comprised of upper and lower bearing housing sections 16 and 18 (FIG. 4), respectively. Thrust and journal bearings are indicated at 20 and 22, respectively. A drain hole 24 opens through the end face of the lower housing section 18 for bolted connection with the flange of a pipe 26. An interior feed pipe 28 is disposed generally concentrically within pipe 26 and drain opening 24. Externally, as illustrated in FIG. 2, a pair of tubes 30 and 32, respectively, extend from penetration openings in the end of the lower housing section 18 to a terminal connection 34 coupled via external tubes 36 to signal readout devices 39. Also, instrumentation in the nature of thermocouples and proximity sensors, not shown, are disposed within the bearing housing 14. It will be appreciated that access to the lower housing section 14 is extremely limited when the upper housing section 16 is removed and the rotor 12 remains in place. The only access is through the space between the rotor end and the interior wall of the lower housing section and the drain hole 24. Thus, it has heretofore been impractical and uneconomical to retrofit bearing housing instrumentation and attendant essential protective guide tubes in a fully assembled turbine with the rotor in place.

Figure 8:
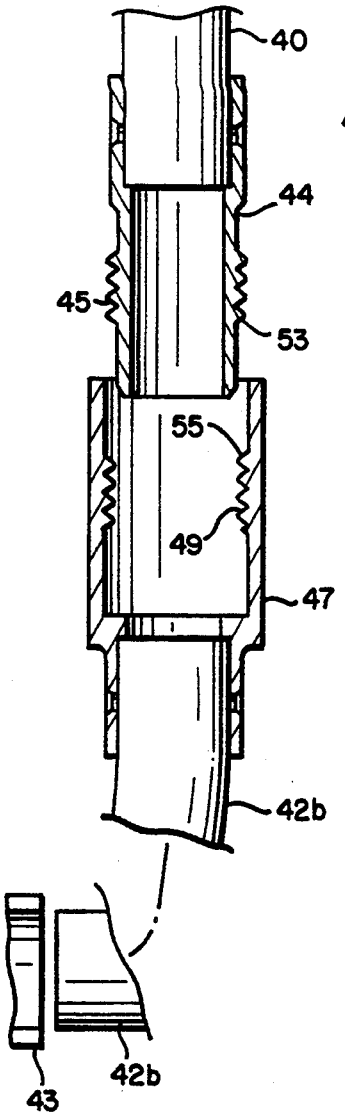
FIGS. 8, 9 and 10 are partial cross-sections illustrating the special fitting used for blind connection of first and second segments forming the thrust bearing instrumentation guide tubes.
Figure 9:
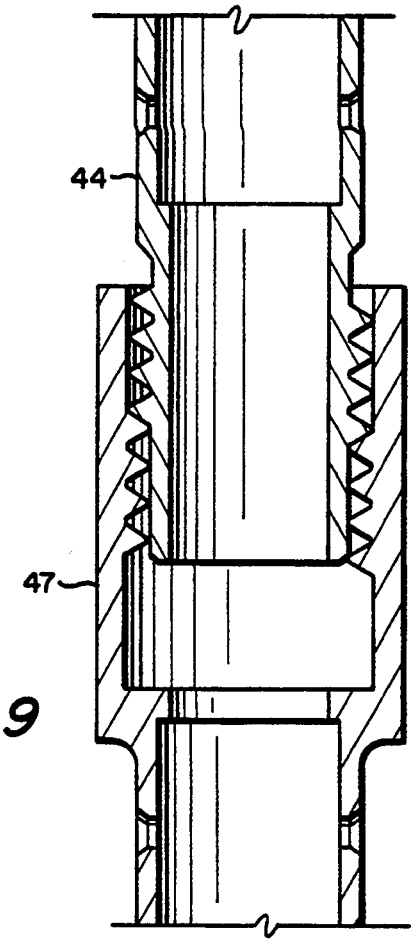
Figure 10:
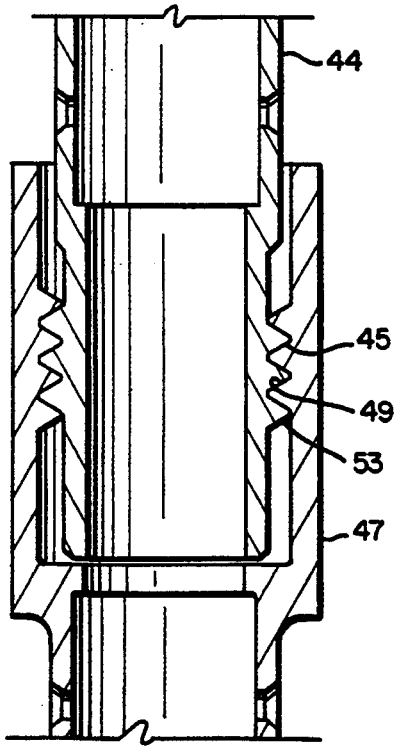

To install such guide tubes without disassembly of the turbine housing or removal of the rotor, a sectional or segmented guide tube is provided for the signal-bearing wires of thrust bearing 20. Thus, first and second guide tubes or segments 40 and 42 are provided for installation in the lower housing section 18 without removal of the rotor or major tear-down of the turbine. As illustrated, the first segment 40 comprises a generally straight section of tube having a special male fitting 44 (FIGS. 8–10) at its lower end provided with threads 45. The second segment 42 comprises an intermediate straight section 42*a*, an elbow defining an upper or innermost end 42*b* and an opposite end having a generally right angle turn 42*c*. Tube end 42*b* of segment 42 has a special female fitting 47 with threads 49 for engagement with the threads of male fitting 44 carried by first segment 40. Additionally, mechanical features enabling the ends of these segments to be remotely readily connected one with the other, and without visual access to the alignment and threading action, are provided. Such features include protruding cylindrical ends on fittings 44 and 47, respectively, and conical surfaces 53 and 55 adjacent to mating threads 45 and 49. Consequently, special male fitting 44 is readily engaged, aligned and connected to special female fitting 47 to form a single tube assembly.

To install the tube assembly without removal of the rotor or other major turbine parts, the upper housing section 14 is removed and the pipe 26 is removed from the oil drain opening 24 to expose the oil drain through the end face of the bearing housing. The housing's tube penetration for segment 42 is machined to provide an outwardly facing shoulder. Segment 42 is then inserted into the drain opening and its plain near end is inserted into the housing's penetration point. A retainer ring a collar 43 is subsequently secured, preferably by welding, to the externally exposed end of segment 42 to form a retaining shoulder. With segment 42 fully inserted into the drain opening, the opposite end of the tube with the female fitting 47 is oriented upwardly within the lower housing section.

Figure 5:
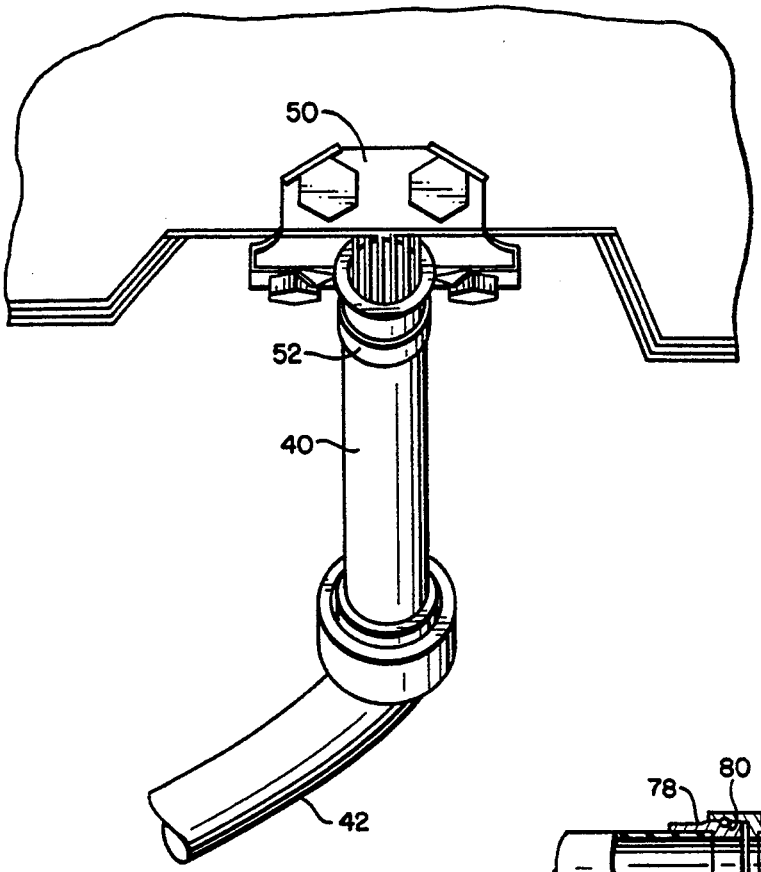
FIG. 5 is an enlarged partial plan view illustrating the connection of the first and second segments of the thrust bearing instrumentation guide tube.

With the assistance of another installer, upper segment 40 is inserted through the open diametrical plane of the lower housing section, with the male fitting 44 facing downwardly. By remotely manipulating the tubes, the installers may align the lower end of first segment 40, i.e., the male fitting 44 and the upwardly directed end of female fitting 47 on segment 42*b*. Because of the loose-fitting different diameters of the protruding cylindrical portions of the male and female fittings, the male fitting and female fittings are readily loosely coupled with the male fitting being received in the female fitting. Upon further insertion, conical surfaces 53 and 55 contact one another in preparation for alignment. By remote relative manipulation of the tubes when loosely coupled, full annular contact of the conical surfaces is obtained, thereby assuring alignment. The conical surfaces enable the installers to rock one tube relative to the other to obtain alignment, and it will be appreciated that joining of these segments is accomplished substantially without the installers having visual access to the joint. When the fittings are aligned and connected by hand, the straight upper portion of segment 40 exposed along the diametrical plane of the lower housing may be used as a wrench to tighten the fittings together. The upper end of segment 40 is provided with a pair of diametrically opposed holes through which a rod may be inserted to facilitate wrenching. Once the threads are finally secured, and with reference to FIG. 5, the upper end of tube 40 is secured by bracket 50, previously secured and bolted, to the lower housing section. To accomplish this, tube clamp 52 is disposed about the upper end of tube 40 and secured to bracket 50. With the thermocouple signal-bearing wires inserted into various components external to the housing, the ends of the wires may be inserted into the tube at the housing penetration point. The wires are then snaked through coupled tubes 42 and 40 until they emerge through the upper end of tube 40 for securement to the thermocouples. It will be appreciated that individual guide tube segments have been inserted, assembled, tightened and mounted to form a rigid guide tube assembly within the lower housing without the removal of the rotor or other turbine components using only access through the upper face of the open lower housing section 18 and the drain opening 24. The threaded connection between guide tubes 40 and 42 is accomplished essentially visually blind and with the aid of the "feel" afforded by the concentricity-enabling conical surfaces.

Figure 4:
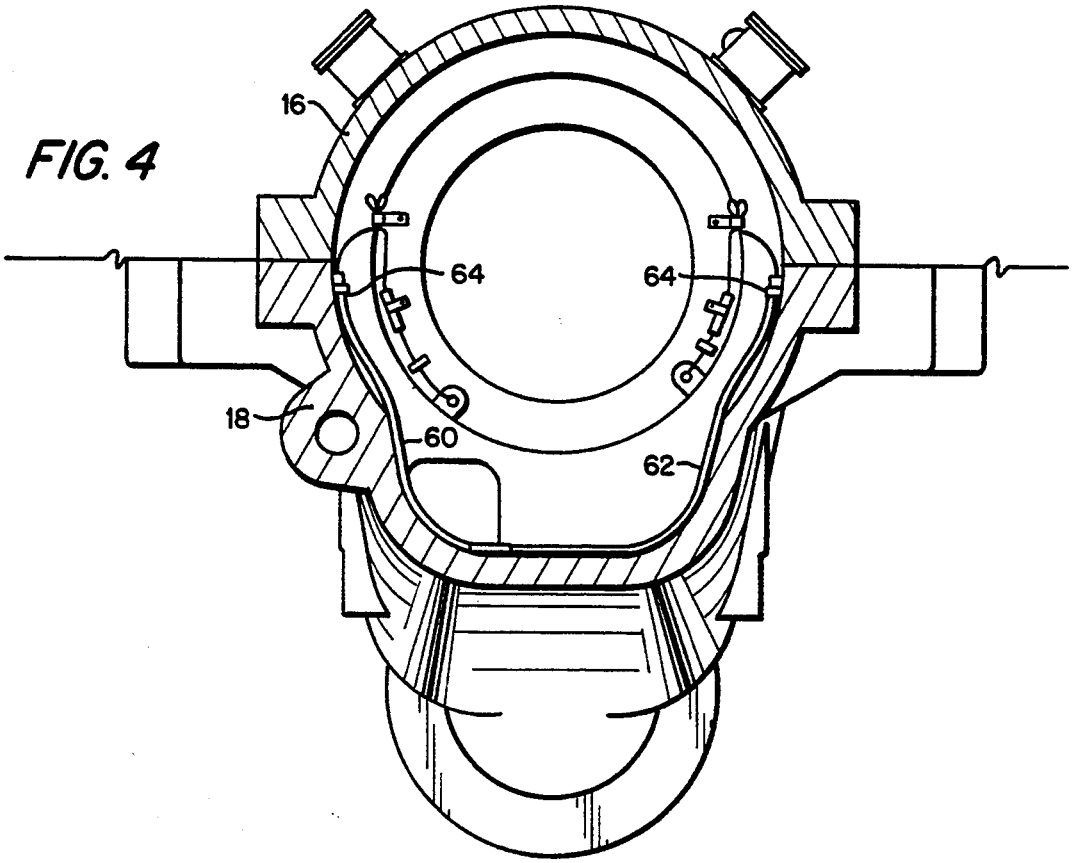
FIG. 4 is a cross-sectional view thereof taken about on line 4—4 in FIG. 3 and with the upper housing section in position on the lower housing section.
Figure 7:
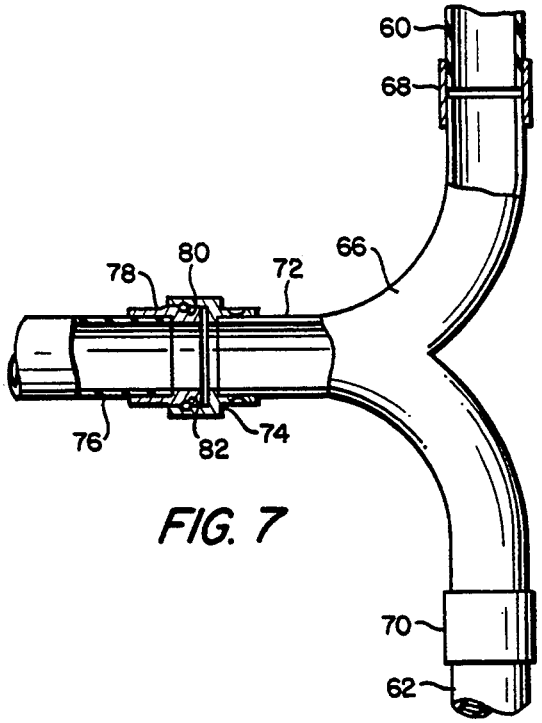
FIG. 7 is an enlarged partial cross-sectional plan view of a Y-tube connection for the journal bearing instrumentation guide tube.

Turning now to the segmented guide tube for carrying the signal-bearing wires from the journal bearing sensors externally to a readout, and with reference initially to FIG. 4, a pair of side guide tubes may be installed in the lower housing 18 through the open upper face of the lower housing section 18. The side guide tubes 60 and 62 may be disposed such that their lower ends are located in a region for connection to a Y-tube connection, to be described. The side guide tubes 60 and 62 may be secured by suitable brackets 64 to the sides of the lower housing section 18. With reference to FIG. 7, a Y-tube connection 66 is provided for connection with the lower ends of side guide tubes 60 and 62. Cylindrical slip joints 68 and 70 are secured, preferably by welding, to the ends of the legs of the Y-tube connection 66. The main leg 72 of the Y-tube connection 66 forms a third guide tube and includes a cylindrical female fitting 74 secured thereto, preferably by welding, for receiving the end of a first guide tube 76. The end of guide tube 76 has a male fitting 78 having an annular groove 80 for receiving a wire 82 for forming a snap-fit with the female fitting 74 on the Y-tube connection 66.

To install the Y-tube connection and couple it to the side guide tubes 60 and 62, pairs of wires, not shown, may be threaded through the Y-tube connection legs and hooked to a similar pair of wires, also not shown, threaded down through the side guide tubes 60 and 62. Once those wire guides are hooked to one another, the lower ends of the side guide tubes 60 and 62 may be received in the slip joints 68 and 70 of the Y-tube connection. The Y-tube connection is disposed in a reduced cavity of the drain opening by initially releasably coupling the first guide tube 76 to the female fitting 74 on the end of Y-tube connection 66. This is accomplished by removing the wire for the permanent snap-fit connection and releasably joining the end of first tube 76 in the female fitting of the Y-tube connection.

Figure 6:
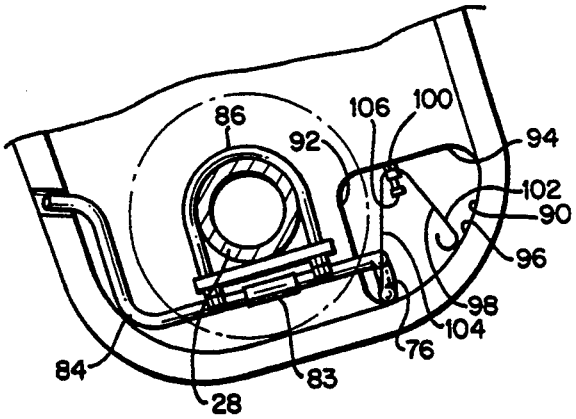
FIG. 6 is an enlarged fragmentary cross-sectional view taken generally about on line 6—6 in FIG. 1.

As best illustrated in FIG. 6, the first tube 76 has, at its opposite end, a connecting sleeve 83 for receiving an end of a second guide tube 84. The opposite end of the second guide tube 84 is receivable in a smooth bore penetration opening in the side wall of the lower housing section 18. A U-shaped clamp is disposed about the interior drain pipe 28 and has a clamp on the end of each leg for securing the adjoining ends of the first and second guide tubes 76 and 84, respectively, with the end of the guide tube 84 received in sleeve 83.

Referring now to FIGS. 1 and 6, it will be appreciated that the drain opening 24 includes a reduced cavity 90 essentially comprising two right-angularly related walls 92 and 94 and an arcuate wall 96 joining the ends of walls 92 and 94. A leaf spring 98, bent to have an apex 100, and a pair of legs 102 and 104 is provided. The apex carries a nut-and-bolt arrangement 106 for adjustably mounting the apex of the spring closer to or further away from the wall surface 94 of the reduced cavity, for reasons noted hereinafter. One leg 104 of the leaf spring 98 is secured to an end portion of the first tube 78. The end of the other leg 102 of leaf spring 98 is free.

To install the guide tubes for the wires for the journal bearing instrumentation, the spring 98 is compressed by tying a line with a slip knot about the spring such that the spring may be received in the reduced cavity 90 upon insertion of the guide tubes into the drain opening. Additionally, the snap ring 82 is applied about the end of the male fitting 78 on the end of tube 76. The guide tubes 76 and 84 are then inserted into the drain opening and are loosely coupled to the clamp 86 with the inner end of tube 84 disposed in sleeve 83. By inserting these loosely assembled guide tubes or parts into the drain opening and the leaf spring carrying with it the first guide tube 76 into the reduced cavity 90, the assembly is approximately positioned. The near end of second guide 84 is then inserted through the housing penetration opening. The forward end of tube 76 is disposed in the female fitting of the Y-tube connection 66 and the snap ring is engaged to permanently secure the tube 76 and Y-tube connection 66 to one another. Also, the slip knot may be remotely loosened and removed, permitting the legs of the leaf spring to engage the walls of the reduced cavity, thus remotely fixing the interior end of the tube assembly within the reduced cavity. Adjustment of the nut-and-bolt arrangement 106 enables the tube assembly to be properly positioned within the cavity with the spring exerting appropriate pressure to fix, i.e., wedge, the inner end of the assembly in the reduced cavity. The joined ends of tubes 76 and 84 may then be clamped by clamp 86 to the drain pipe 28. The signal-bearing wires may then be snaked through the assembled guide tubes and Y-tube connection. Alternatively, the wires or cables may be snaked through the guide tubes in their disassembled condition that, upon assembly, the wires or cables will be disposed within the guide tubes.

Variations in the above-described installation procedures are quite possible and within the scope of this invention. For example, the Y-tube connection need not be initially inserted for connection with the side guide tubes. It may be secured to the end of the first tube and initially installed with the first tube, guide wires with hooks being passed through the first and second guide tubes and the Y-tube connection for coupling with similar guide wires with hooks passed through the side guide tubes for joining the legs of the Y-tube connection and the side guide tubes. Other variations in installation procedures will readily suggest themselves to persons of skill in this art.

While the invention has been described with respect to what is presently regarded as the most practical embodiments thereof, it will be understood by those of ordinary skill in the art that various alterations and modifications may be made .which nevertheless remain within the scope of the invention as defined by the claims which follow.

What is claimed is:

1. A turbine comprising:

a rotor;

bearings for said rotor;

a housing for the bearings of the rotor split to define upper and lower housing sections;

a lubricating drain hole opening through the lower housing section;

means for guiding signal-bearing wires from instrumentation located within said bearing housing to at least one signal readout device external of said housing and receivable within the lower housing section upon removal of the upper housing section but without removal of the rotor;

said means including a first generally linearly extending guide tube having a lower threaded end and receivable within said lower housing section, a second guide tube having an upper threaded end and receivable within the drain hole for threaded engagement with the lower end of said first guide tube, and means carried by at least one of said guide tubes at its lower end and said second guide tube at its upper threaded end for ensuring alignment of said guide tube ends to facilitate substantially blind threaded engagement of said ends within the lower housing section.

2. A turbine according to claim 1 including a collar on the end of said second tube opposite said upper threaded end for retaining said second tube within a penetration hole formed in said housing.

3. In a turbine having a rotor, a housing for the bearings of the rotor split to define upper and lower housing sections, and a lubrication drain hole opening through the lower housing section, apparatus for installing guide tubes and signal-bearing wires from instrumentation located within the bearing housing to at least one signal readout device external of said housing and receivable within the lower housing section upon removal of the upper housing section but without removal of the rotor, comprising:

a first generally linearly extending guide tube and a second guide tube;

a connecting sleeve for slip-joining ends of said guide tubes one to the other, a third guide tube within said lower housing part and connected to an opposite end of said first guide tube, mounting means for said first and second guide tubes including a clamp for rigid securement within said lower housing section and within the drain hole for securing ends of said first and second tubes adjacent said sleeve with said sleeve located between the clamped ends of said first and second tubes, and means coupled to said first tube adjacent said opposite end for securing said first tube to said housing within said drain hole.

4. Apparatus according to claim 3 wherein said securing means includes means for biasing said opposite end of said first tube against a wall of said housing.

5. Apparatus according to claim 4 wherein said biasing means includes a spring having a pair of leg portions joined at an apex with one of said leg portions being secured to said opposite end of said first tube, the apex and ends of said leg portions bearing against the walls of said housing defining the drain hole.

6. Apparatus according to claim 1 wherein said alignment means includes male and female fittings on the ends of the first and second guide tubes to be engaged having diameters such that when the male fitting is received in the female fitting, a substantial annular space is formed between the fittings, the female fitting having internal threads and the male fitting having external threads spaced back from the respective ends of the fittings.

* * * * *